United States Patent [19]

Kuroki et al.

[11] Patent Number: 4,753,692

[45] Date of Patent: Jun. 28, 1988

[54] GRAIN-ORIENTED ELECTROMAGNETIC STEEL SHEET AND PROCESS FOR PRODUCING THE SAME

[75] Inventors: Katsuro Kuroki; Toshiya Wada; Shozaburo Nakashima, all of Kitakyushu, Japan

[73] Assignee: Nippon Steel Corporation, Tokyo, Japan

[21] Appl. No.: 876,653

[22] Filed: Jun. 17, 1986

Related U.S. Application Data

[60] Continuation of Ser. No. 603,998, Apr. 27, 1984, abandoned, which is a division of Ser. No. 405,106, Aug. 4, 1982, abandoned.

[30] Foreign Application Priority Data

Aug. 5, 1981 [JP] Japan ..... 56-122727

[51] Int. Cl.[4] ..... H01F 1/04

[52] U.S. Cl. ..... 148/111; 148/113

[58] Field of Search ..... 148/111, 112, 113

[56] References Cited

U.S. PATENT DOCUMENTS

| | | | |
|---|---|---|---|
| 3,239,332 | 3/1966 | Goss | 148/31.55 |
| 3,770,517 | 11/1973 | Gray et al. | 148/112 |
| 3,855,018 | 12/1974 | Salsgiver et al. | 148/112 |
| 3,855,020 | 12/1974 | Salsgiver et al. | 148/31.55 |
| 3,873,380 | 3/1975 | Malagari | 148/31.55 |
| 3,929,522 | 12/1975 | Salsgiver et al. | 148/112 |
| 3,933,024 | 1/1976 | Matsumoto et al. | 148/113 |
| 3,940,299 | 2/1976 | Goto et al. | 75/123 L |
| 4,046,602 | 9/1977 | Stanley | 148/31.55 |
| 4,113,529 | 9/1978 | Fiedler | 148/31.55 |
| 4,123,299 | 10/1978 | Fiedler et al. | 148/31.55 |
| 4,244,757 | 1/1981 | Malagari et al. | 148/112 |
| 4,338,144 | 7/1982 | Fiedler | 148/113 |
| 4,493,739 | 1/1985 | Fujiwara et al. | 148/111 |

FOREIGN PATENT DOCUMENTS

| | | |
|---|---|---|
| 4015644 | 7/1969 | Japan . |
| 49-72118 | 7/1974 | Japan . |
| 53-134722 | 11/1978 | Japan . |
| 54-13846 | 6/1979 | Japan . |
| 54-29182 | 9/1979 | Japan . |

OTHER PUBLICATIONS

Journal of Magnetism and Magnetic Materials 2 (1976), 121–131, The Development of Grain-Oriented Silicon Steel with High Permeability, S. Taguchi, A. Sakakura et al.

Journal of Applied Physics, vol. 41, No. 7, 2981–2984, Effects of Tensile Stress on Total Loss of Single Crystals of 3% Silicon-Iron, Jun. 1970.

Journal of Applied Physics vol. 55, 15 Mar. 1984, No. 6, Part IIB, Roles of Tin and Copper in the 0.23 mm Thick High Permeability Grain-Oriented Silicon Steel, K. Iwayama, K. Kuroki, et al., pp. 2136–2138.

Translations ISIJ, vol. 17, 1977, 32–43, Review of the Recent Development of Electrical Sheet Steel in Japan by Satoru Taguchi.

*Primary Examiner*—John P. Sheehan

*Attorney, Agent, or Firm*—Kenyon & Kenyon

[57] ABSTRACT

In a grain-oriented electromagnetic steel sheet which is produced by a process including a cold-rolling step(s), the final reduction ratio of the cold-rolling step(s) being high, a technical means for refining the secondary recrystallized grains is particularly important. One technical means is the incorporation of tin into silicon steel material. This, however, involves a problem because tin incorporated into silicon steel material deteriorates the surface coating which imparts tension to a grain-oriented electromagnetic steel sheet.

The incorporation of copper into silicon steel material has been avoided since it causes secondary recrystallization to be unstable.

The present invention is characterized by the combined incorporation of tin and copper into molten steel so as to simultaneously refine the secondary recrystallized grains and to form a good surface coating. The grain-oriented electromagnetic steel sheet of the present invention contains from 2.5% to less than 4.0% of silicon, from 0.03% to 0.15% of manganese, from 0.03% to 0.5% of tin, and from 0.02% to less than 0.3% of copper.

8 Claims, 3 Drawing Sheets

X 1000

GRAIN-ORIENTED ELECTROMAGNETIC STEEL SHEET AND PROCESS FOR PRODUCING THE SAME

This is a continuation of application Ser. No. 603,998, filed Apr. 27, 1984, abandoned in favor hereof, which was a division of applications Ser. No. 405,106, filed Aug. 4, 1982, abandoned in favor thereof.

The present invention relates to a grain-oriented electromagnetic steel sheet or strip having a low watt loss and a high magnetic flux density and also to a process for producing such grain-oriented electromagnetic steel sheet or strip.

The descriptions hereinunder relate mainly to a grain-oriented electromagnetic steel sheet. A grain-oriented electromagnetic steel sheet is used as a soft magnetic material for the core of transformers and other electrical machinery and apparatuses. As magnetic properties of a grain-oriented electromagnetic steel sheet, the exciting characteristic must be excellent and the watt loss must be low. In order to obtain a grain-oriented electromagnetic steel sheet having excellent magnetic properties, it is important to align the <001> axis of the crystals of a grain-oriented electromagnetic steel sheet in the rolling direction at a high degree of orientation, the axis being the easy direction of magnetization. In addition to this, the grain size, resistivity, and surface coating of a grain-oriented electromagnetic steel sheet exert a great influence on the magnetic properties. The development of a single-stage cold-rolling process has drastically enhanced the degree of orientation, and grain-oriented electromagnetic steel sheets presently being produced exhibit a magnetic flux density amounting to approximately 96% of the theoretical value. Due to enhancement of the degree of orientation, watt loss can be drastically decreased. Nevertheless, a further decrease of watt loss is not possible only by enhancement of the degree of orientation; rather, technical means for increasing the resistivity mentioned above and for refining the secondary recrystallized grains are necessary to attain such further decrease of watt loss.

A technical means for refining the secondary recrystallized grains is particularly important in the single-stage cold-rolling process, in which the final reduction ratio is high, since it is probable that in this process watt loss may not be reduced in proportion to the enhanced degree of orientation achieved in the single-stage cold-rolling process. More specifically, the positive effect of enhancement of the degree of orientation tends to be neutralized by the negative effect of increment of the size of the secondary recrystallized grains with the result that a decrease in watt loss cannot be expected. This tendency is more prominent with increase in thickness of grain-oriented electromagnetic steel sheet.

Japanese Unexamined Patent Publication No. 53-134722 (1978) proposes to incorporate tin into a silicon steel material containing a minor amount of aluminum so as to attain refinement of the secondary recrystallized grains while maintaining a high degree of orientation.

The incorporation of tin into the silicon steel material mentioned above, however, involves a problem in that tin may deteriorate the surface coating of a grain-oriented electromagnetic steel sheet. As is well known, the surface coating of a grain-oriented electromagnetic steel sheet not only plays an important role in insulating the laminated sheet sections of a transformer from each other but also imparts tension to said steel sheet due to the difference in the thermal expansion coefficient between said surface coating and said steel sheet, with the result that watt loss is greatly decreased. Therefore, although refinement of the secondary recrystallized grains may be attained by incorporating tin into the silicon steel material, watt loss cannot be satisfactorily decreased due to deterioration of the surface coating mentioned above.

Japanese Unexamined Patent Publication No. 49-72118 (1974) discloses to incorporate copper alone into steel composition containing aluminum. However, the incorporation of copper alone disadvantageously results in coarsening of secondary recrystallized grains.

It is an object of the present invention to refine the secondary recrystallized grains of a grain-oriented electromagnetic steel sheet or strip by providing such steel sheet or strip with a novel composition by which the surface coating of the steel sheet or strip is improved, the secondary recrystallized grains are refined, and the grain-orientation is not impaired.

It is another object of the present invention to provide a process for producing a grain-oriented electromagnetic steel sheet or strip in which the secondary recrystallized grains are refined and, further, the properties of the surface coating are improved, with the result that low watt loss can be ensured particularly at a high magnetic flux density.

In accordance with the objects of the present invention, there is provided a grain-oriented electromagnetic steel sheet or strip having a low watt loss and a high magnetic flux density, characterized in that it contains from 2.5% to less than 4.0% of silicon, from 0.03% to less than 0.15% of manganese, from 0.03% to less than 0.5% of tin, and from 0.02% to less than 0.3% of copper, the remaining percentage being iron and unavoidable impurities.

In accordance with the objects of the present invention, there is also provided a process for producing a grain-oriented electromagnetic steel sheet or strip having a low watt loss and a high magnetic flux density, characterized in that a silicon steel material, containing not more than 0.085% of carbon, from 2.5% to 4.0% of silicon, from 0.03% to 0.15% of manganese, from 0.010% to 0.050% of sulfur, from 0.010% to 0.050% of acid-soluble aluminum, and from 0.0045% to 0.012% of nitrogen and additionally containing from 0.03% to 0.5% of tin and from 0.02% to 0.3% of copper is hot-rolled, precipitation-annealed, cold-rolled at a final reduction ratio of not less than 65%, decarburization-annealed, and final-annealed.

A grain-oriented electromagnetic steel sheet or strip may be provided with a surface coating which preferably comprises $Mg_2SiO_4$ and which preferably has a thickness of about 3 microns.

The preferable properties of a grain-oriented electromagnetic steel sheet having thickness of from 0.35 to 0.15 mm according to the present invention are:

Watt loss ($W_{17/50}$): 1.00~0.90 watts/kg
Watt loss ($W_{15/50}$): 0.76~0.67 watts/kg
ASTM grain size: No. 4~No. 7
Magnetic flux density ($B_8$): 1.88 1.96 tesla The present invention is characterized by incorporating into molten silicon steel copper which is effective for the formation of a good surface coating of a grain-oriented electromagnetic steel sheet. In other words, conventional methods for improving such surface coating reside in the incorporation of an element into the annealing separator. However, such conventional methods cannot fundamentally improve the surface coating of a grain-oriented electromagnetic steel sheet which contains tin because an element which is incorporated into the surface coating cannot prevent the surface coating from being influenced by the oxide film which is formed on the steel sheet during decarburization-annealing. Based on the present inventors' concept described above, the present inventors incorporated copper into molten silicon steel in addition to tin in an attempt to utilize the favorable effects of copper. Since the secondary recrystallized structure is considerably influenced by the incorporation of copper, the incorporation of copper has usually been avoided. Fortunately, in the present invention, when copper was incorporated in addition to tin the favorable effects of both elements were utilized and the unfavorable effects of copper were neutralized by the favorable effects of tin and vice versa.

More specifically, copper is a very excellent element which can be utilized in the formation of the surface coating of a grain-oriented electromagnetic steel sheet, and the qualities, especially the adhesive property, of such a surface coating are improved by the copper. Copper, however, tends to coarsen the secondary recrystallized grains. Contrary to this, tin contributes to refinement of the secondary recrystallized grains but it deteriorates the surface coating of a grain-oriented electromagnetic steel sheet. According to the present invention, the advantages resulting from the combined use of copper and tin are maintained and the disadvantages resulting from the combined use of copper and tin are eliminated, this phenomenon being a discovery by the present inventors.

The present invention is now quantitatively described.

First, the composition of a silicon steel material, which is the starting material of the process according to the present invention, is described. The silicon steel material contains as basic elements not more than 0.085% of carbon, from 2.5% to 4.0% of silicon, from 0.010% to 0.050% of acid-soluble aluminum, from 0.03% to 0.15% of manganese, and from 0.010% to 0.050% of sulfur and also contains as characteristic elements from 0.03% to 0.5% of tin and from 0.02% to 0.3% of copper.

The carbon content is limited to not more than 0.085% because the decarburization-annealing period is long when the carbon content exceeds 0.085%. A silicon content of at least 2.5% is necessary for attaining low watt loss. However, a silicon content exceeding 4.0% disadvantageously renders cold-rolling difficult. Secondary recrystallization is not stabilized when the content of acid-soluble aluminum does not fall within the range of from 0.010% to 0.050%.

Manganese and sulfur are necessary for forming MnS. An appropriate amount of manganese is from 0.03% to 0.15% and a preferable amount of manganese is from 0.05% to 0.10%. When the sulfur content exceeds 0.05%, desulfurization during purification-annealing becomes difficult. On the other hand, a sulfur content of less than 0.01% is too low to form a satisfactory amount of MnS, MnS being one of the inhibitors.

Tin in an amount of less than 0.03% is too low to effectively attain refinement of the secondary recrystallized grains. On the other hand, when the tin content exceeds 0.5%, the operating efficiency during rolling and pickling is deteriorated. The combined incorporation of tin and copper also causes the operating efficiency to deteriorate. The preferable tin content is from 0.05% to 0.20%.

Copper in an amount of less than 0.02% is too small to improve the surface coating of a grain-oriented electromagnetic steel sheet while copper in an amount exceeding 0.3% is undesirable in the light of the magnetic properties of a grain-oriented electromagnetic steel sheet. The preferable copper content is from 0.05% to 0.15%.

The proportion of tin to copper exerts an influence on the surface coating and on refinement of the secondary recrystallized grains of a grain-oriented electromagnetic steel sheet.

BRIEF DESCRIPTION OF THE DRAWINGS

The present invention is hereinafter explained with reference to the drawings, wherein:

FIG. 1 shows the proportion of the tin to copper contents, which proportion was varied, in the silicon steel materials tested. The tested silicon steel materials contained 0.056% of carbon, 2.96% of silicon, 0.076% of manganese, 0.025% of sulfur, 0.027% of acid-soluble aluminum, 0.0075% of nitrogen, and 0.2% of tin. In addition, the content of copper was varied so as to give the proportion of tin to copper shown by the abscissa. In the figure $W_{17/50}$ is the watt loss at a magnetic flux density of 1.7 tesla and 50 Hz, and the grain size is expressed according to the ASTM standard at a magnification of $\times 1$. The tension generated due to the surface coating was obtained by calculating the amount of deflection of the grain-oriented electromagnetic steel sheets having a surface coating on only one of the surfaces thereof. The deflection was brought about by applying on the final-annealed steel sheets a coating liquid mainly composed of phosphoric acid, chromic acid anhydride and aluminum phosphate, subjecting the sheets to flattening-annealing, and removing the surface coating from said one surface of the steel sheets with acid.

Watt loss ($W_{17/50}$) is very low when the proportion of tin to copper is in the range of from 1:0.5 to 1:1. In this range, an appreciable decrease in grain size due to tin and an appreciable increase in the tension of the surface coating are simultaneously attained. A preferable proportion of tin to copper is approximately 1:0.75.

The watt loss ($W_{17/50}$) tends to be very low, and the tension generated by the surface coating and the grain size tend to increase and decrease, respectively, when the proportion of the tin to copper content is in the range of from 1:0.5 to 1:1 not only in the case of a tin content of 0.2% but also in the case of a different tin content.

It is not clear why copper is effective for the formation of a good surface coating on a grain-oriented electromagnetic steel sheet. In order to form a good surface coating on a grain-oriented electromagnetic steel sheet, the properties of an oxide film, which is formed during decarburization-annealing and which underlies the surface coating, must be good. As the results of the present inventors' experiment showed, the thickness of the surface coating was more uniform when tin and copper were incorporated into silicon steel material in combination than when only tin was incorporated.

Presumably, the oxide film mentioned above comprises, in addition to oxides of iron, silicon, and aluminum, oxides of tin and copper, the copper oxide improving the properties of the oxide film and contributing to the formation of a good surface coating.

Figure 1:
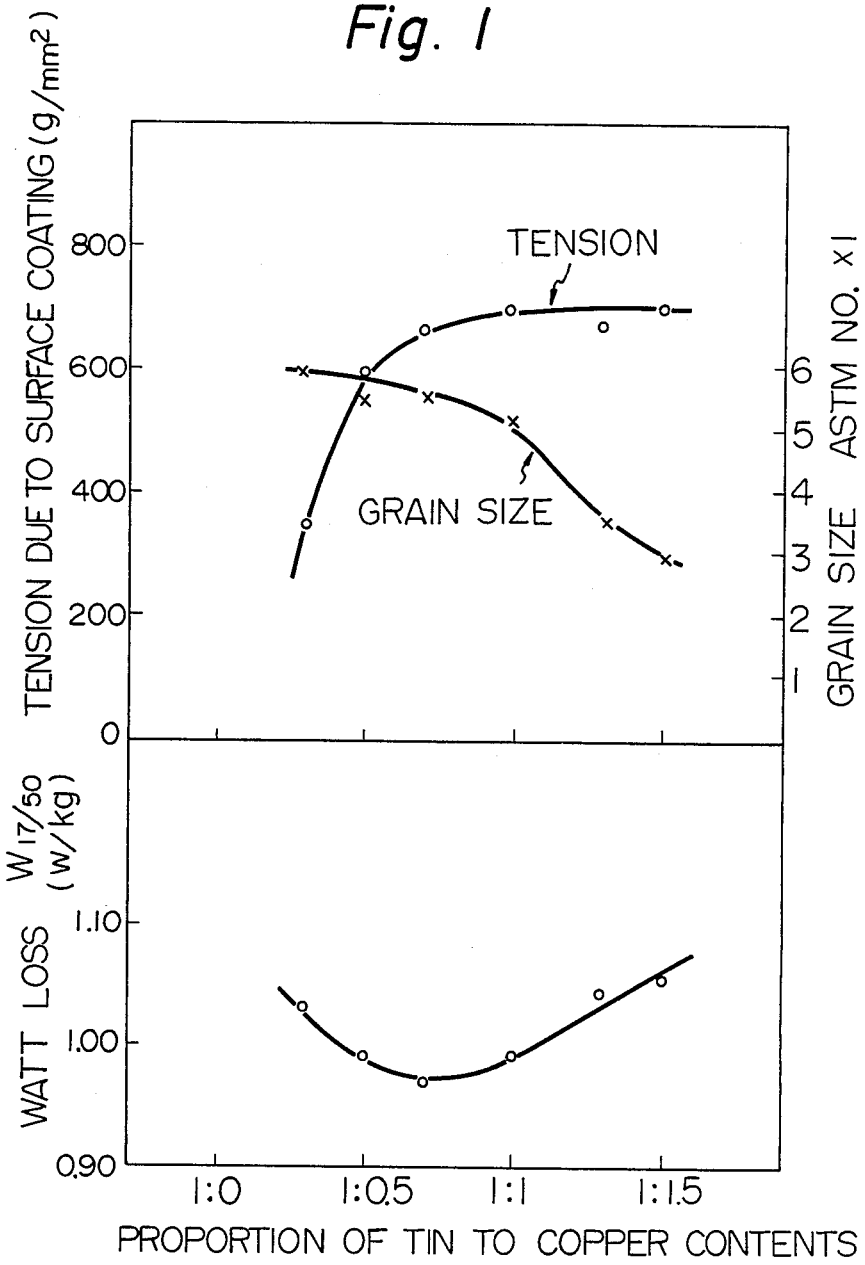
FIG. 1 illustrates how the proportion of tin to copper contents exerts an influence on the watt loss and grain size of a grain-oriented electromagnetic steel sheet, as does tension generated due to the surface coating of a grain-oriented electromagnetic steel sheet.
Figure 2A:
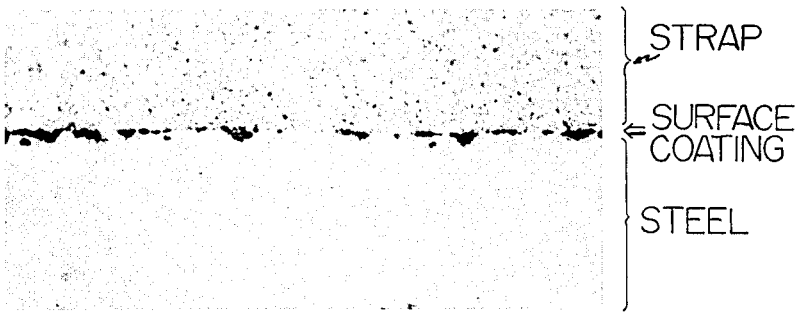
FIG. 2A is an optical microscope photograph showing the cross section of a grain-oriented electromagnetic steel sheet having a surface coating thereon and containing tin only.
Figure 2B:
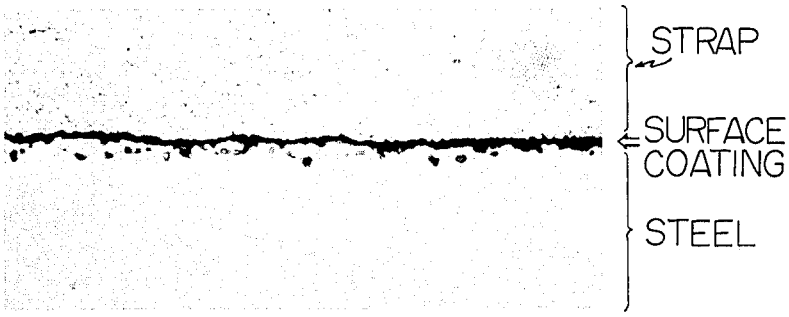
FIG. 2B is an optical microscope photograph showing the cross section of a grain-oriented electromagnetic steel sheet having a surface coating thereon containing both tin and copper.

In FIG. 2A, the silicon steel material contained 3% of silicon and 0.2% of tin while in FIG. 2B the silicon steel material contained 3% of silicon, 0.2% of tin, and 0.11% of copper. After final-annealing, surface coating was formed on each grain-oriented electromagnetic steel sheet. A strap was attached to the surface coating of each steel sheet so that the surface coating could be observed with an optical microscope. Each grain-oriented electromagnetic steel sheet having a surface coating and a strap thereon was cut into a cross section which was observed at a magnification of 1000. In FIG. 2A, the surface coating was discontinuous in several places. In FIG. 2B the thickness of the surface coating was uniform, indicating that the incorporation of copper drastically improved the uniformity of the surface coating.

In addition to the carbon content, manganese content, tin content, and copper content described hereinabove, from 0.0045% to 0.012% of nitrogen, which is one of the indispensable elements, must be contained in silicon steel material so as to effectively precipitate AlN, AlN being another inhibitor. Silicon steel material may further contain unavoidable impurities, such as nickel, chromium, and titanium, in a minor amount.

Next, a process for producing a grain-oriented electromagnetic steel sheet according to the present invention will be described.

Silicon steel material containing the elements described above may be produced by any known melting, ingotor slab-making, and rough-rolling methods. Such silicon steel material is then hot-rolled by means of a conventional method so as to produce a hot-rolled coil. Then the hot-rolled coil is subjected to either single-stage cold-rolling or double-stage cold-rolling including intermediate annealing, the final thickness being obtained during single-stage or double-stage cold-rolling. A high final cold-rolling reduction ratio of from 65% to 95%, preferably from 80% to 92%, is necessary in the final cold-rolling step so as to ensure a high magnetic flux density of a grain-oriented electromagnetic steel sheet.

When the cold-rolling reduction ratio is less than 65%, a high magnetic flux density cannot be obtained. On the other hand, when the cold-rolling reduction ratio exceeds 95%, growth of secondary recrystallized grains is unstable. A cold-rolling reduction ratio at a step(s) other than the final cold-rolling step is not specified.

The magnetic properties of a grain-oriented electromagnetic steel sheet, which are improved due to the combined incorporation of tin and copper, can be further improved when aging at a temperature of from 300° C. to 600° C. is carried out between the cold-rolling passes in accordance with the disclosures of Japanese Examined Patent Publication No. 54-13866 (1979) and Japanese Examined Patent Publication No. 54-29182 (1979). In addition, as is disclosed in Japanese Examined Patent Publication No. 40-15664, the precipitation of AlN may be controlled by carrying out annealing at a temperature of from 950° C. to 1200° C. for from 30 seconds to 30 minutes, followed by rapid cooling.

A sheet which has been subjected to cold-rolling so that a final sheet thickness is obtained is subjected to conventional decarburization-annealing. During decarburization-annealing, not only do decarburization and primary recrystallization of the cold-rolled sheet take place but also an oxide film, which is necessary for the application of a surface coating, is formed on the cold-rolled sheet. Therefore, not only do the conditions of decarburization-annealing greatly influence the properties of the surface coating, which is applied on a grain-oriented electromagnetic steel sheet after final-annealing, but they also influence the magnetic properties of a grain-oriented electromagnetic steel sheet. Preferable decarburization-annealing conditions are: an annealing temperature of from 800° C. to 900° C.; holding the annealing temperature for from 30 seconds to 10 minutes; and a protective atmosphere for annealing comprising wet hydrogen, wet nitrogen, or a mixture of wet hydrogen and nitrogen.

After decarburization-annealing, an annealing separator is applied on the resultant steel sheet so as to prevent sticking of said sheet during final annealing and as a preparatory step in the formation of the surface coating of a grain-oriented electromagnetic steel sheet. The annealing separator is not restricted to a specific composition but is preferably composed mainly of MgO and $TiO_2$. Final annealing is carried out at a temperature of 1100° C. or higher for 5 hours or longer in a hydrogen- or hydrogen-containing protective atmosphere. During final annealing, an inorganic coating is formed on the surface of the resultant grain-oriented electromagnetic steel sheet.

Subsequently, a coating liquid mainly composed of phosphoric acid, chromic acid anhydride, and aluminum phosphate is applied on the grain-oriented electromagnetic steel sheet, which is then subjected to flattening-annealing, with the result that the coating liquid imparts strength to the resultant surface coating and tension to the surface of the grain-oriented electromagnetic steel sheet, this strength and tension being superior to the strength and tension of the inorganic coating mentioned above.

Now, the composition of and several properties of a grain-oriented electromagnetic steel sheet according to the present invention are described.

The grain-oriented electromagnetic steel sheet of the present invention contains from 2.5% to less than 4.0% of silicon, from 0.03% to less than 0.15% of manganese, from 0.03% to less than 0.5% of tin, and from 0.02% to less than 0.3% of copper, the remaining percentage being iron and unavoidable impurities. Silicon, which increases the resistivity of steel, manganese, which contributes to the growth of the secondary recrystallized grains, tin, which contributes to refinement of the secondary recrystallized grains, and copper, which improves the quality of the surface coating, remain in the grain-oriented electromagnetic steel in virtually the same amounts as in a silicon steel material although the content of each of these elements is slightly decreased during the process of producing a grain-oriented electromagnetic steel sheet. The other elements, such as carbon, sulfur, nitrogen, and aluminum, remain in the final product, i.e., the grain-oriented electromagnetic steel sheet, in trace amounts since they are removed during the annealing steps. In addition, these elements are merely impurities of the grain-oriented electromagnetic steel sheet since they play a roll during the process of producing the grain-oriented electromagnetic steel sheet. The values of the final product can be enhanced by decreasing the content of these impurities as much as possible.

The grain-oriented electromagnetic steel sheet of the present invention has a small grain size in the range of from No. 4 to 7 according to the ASTM standard (at a magnification of×1) without the degree of orientation being decreased. The grain size mentioned above is at least one size smaller than the conventional grain size according to the ASTM standard. The tension generated due to the surface coating in the present invention is equivalent to the conventional one.

Watt loss of a grain-oriented electromagnetic steel sheet of the present invention is very low, and such very low watt loss can be attained obviously when the sheet thickness is great and even when the sheet thickness is 0.25 mm or less and hence small. According to the present invention, it is possible to stably produce a grain-oriented electromagnetic steel sheet having a very low watt loss not only when the sheet thickness is great but also when the sheet thickness is small, i.e. from 0.15 to 0.20 mm.

The present invention is hereinafter explained by way of examples.

EXAMPLE 1

Figure 3:
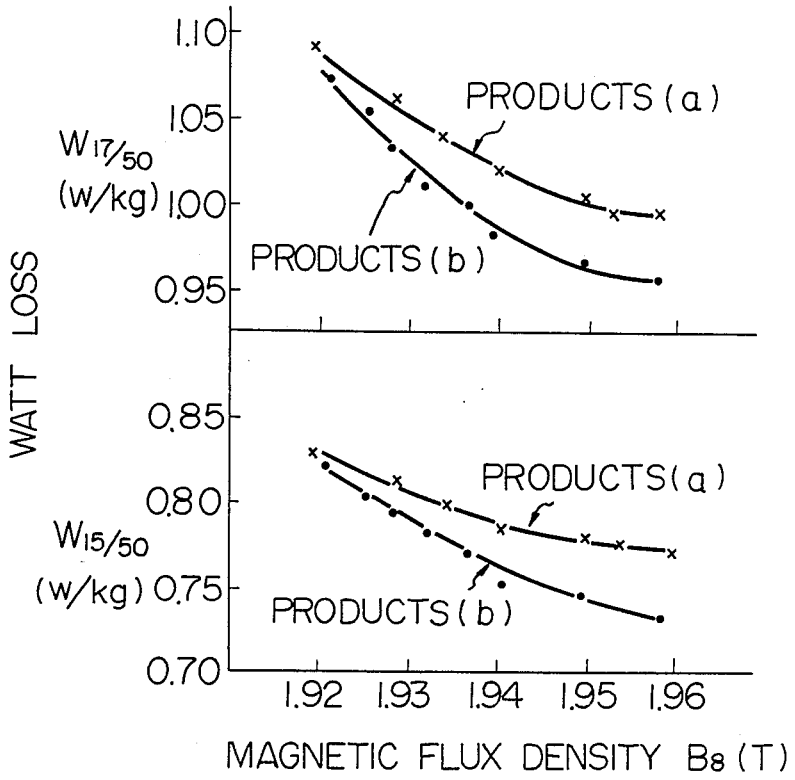
FIG. 3 illustrates the relationships between watt loss ($W_{17/50}$ and $W_{15/50}$) and magnetic flux density ($B_8$) with regard to a conventional grain-oriented electromagnetic steel sheet having a high magnetic flux density (a) and the grain-oriented electromagnetic steel sheet of the present invention (b).

In FIG. 3, conventional grain-oriented electromagnetic steel sheets (a) having a high magnetic flux density (hereinafter simply referred to as the products (a)) were produced by using AlN as the main inhibitor while grain-oriented electromagnetic steel sheets (b) having a high magnetic flux density (hereinafter simply referred to as the products (b)) were similarly produced by using AlN as the main inhibitor and incorporating tin and copper into the molten steel.

The composition of the products (a) and (b) are given in Table 1.

TABLE 1

| Products | Si (%) | Mn (%) | Sn (%) | Cu (%) | Other Elements | ASTM Grain-size (× 1) |
|---|---|---|---|---|---|---|
| (a) | 2.90~3.0 | 0.070~0.075 | <0.01 | <0.01 | Iron and minor amounts of Al, C, N, S, and the like | 3 |
| (b) | 2.90~3.0 | 0.070~0.075 | 0.08~0.18 | 0.06~0.10 | Iron and minor amounts of Al, C, N, S, and the like | 5.5 |

As is apparent from FIG. 3, the watt loss of the products (b) is lower than the watt loss of the products (a). In addition, the watt-loss difference between the products (a) and the products (b) becomes greater at a higher magnetic flux density, indicating that the reduction in watt loss due to refinement of the secondary recrystallized grains becomes more appreciable when the magnetic flux density of the grain-oriented electromagnetic steel sheet is high.

EXAMPLE 2

The three ingots produced contained 0.056% of carbon, 3.05% of silicon, 0.075% of manganese, 0.023% of sulfur, 0.027% of acid-soluble aluminum, and 0.0080% of nitrogen. One of the ingots additionally contained 0.15% of tin, and another ingot additionally contained 0.15% of tin and 0.09% of copper. The composition of each of the three ingots is given in Table 2.

TABLE 2

| Ingot | C (%) | Si (%) | Mn (%) | S (%) | $^{Sol}$Al (%) | N (%) | Sn (%) | Cu (%) |
|---|---|---|---|---|---|---|---|---|
| (d) | 0.056 | 3.05 | 0.078 | 0.023 | 0.027 | 0.0080 | — | — |
| (e) | 0.056 | 3.05 | 0.078 | 0.024 | 0.027 | 0.0078 | 0.15 | — |
| (f) | 0.056 | 3.05 | 0.078 | 0.023 | 0.026 | 0.0078 | 0.15 | 0.09 |

These ingots were hot-rolled after being heated to 1350° C. so as to obtain hot-rolled sheets having a thickness of 2.3 mm. Subsequently, precipitation annealing was carried out at 1150° C. for 2 minutes, followed by rapid cooling in at water having a temperature of 100° C. The hot-rolled sheets were then pickled and cold-rolled so as to reduce the sheet thickness to 0.30 mm. During cold-rolling, aging at a temperature of 250° C. for 3 minutes was carried out between the cold-rolling passes. Subsequently, decarburization-annealing was carried out at a temperature of 850° C. for 150 seconds in an atmosphere consisting of 75% hydrogen and 25% nitrogen and having a dew point of 62° C. An annealing separator consisting of a mixture of MgO and $TiO_2$ was applied on the decarburization-annealed steel sheets and then final-annealing was carried out at a temperature of 1200° C. for 20 hours. Subsequently, a coating liquid, which was mainly composed of phosphoric acid, chromic acid anhydride, and aluminum phosphate, was applied on the final-annealed steel sheets, which were then subjected to flattening-annealing.

The magnetic properties and grain size of the final products (d), (e), and (f) which were produced using the ingots (d), (e), and (f), respectively, were measured. In addition, the appearance, adhesion property, and tension of the surface coatings of each of the final products were determined. In determining the adhesion property, test samples of the final products (d), (e), and (f) were bent around a rod 20 mm in diameter and then the surface coating of each sample was examined for peeling. In determining the tension, the surface coating was removed from one surface of each of the final products (d), (e), and (f) and then the deflection was measured.

The following table shows the properties of the final products (d), (e), and (f).

TABLE 3

| Final Product | Magnetic Properties $B_8$ (T) | W17/50 (W/Kg) | Grain size ASTM No. × 1 | Property of Surface Coating Appearance | Adhesion Property | Tension (g/mm²) |
|---|---|---|---|---|---|---|
| (d) | 1.94 | 1.03 | 3 | Good | o | 650 |
| (e) | 1.94 | 1.02 | 5.5 | Thin as a whole | x | 260 |
| (f) | 1.94 | 0.98 | 5 | Good | o | 650 |

The composition of each of the final products (d), (e), and (f) is shown in Table 4.

TABLE 4

| Final Product | Si (%) | Mn (%) | Sn (%) | Cu (%) | Other Elements |
|---|---|---|---|---|---|
| (d) | 2.95 | 0.070 | — | — | Iron and minor amounts of Al, C, N, S and the like |
| (e) | 2.95 | 0.070 | 0.14 | — | Iron and minor amounts of Al, C, N, S and the like |
| (f) | 2.95 | 0.070 | 0.14 | 0.08 | Iron and minor amounts of Al, C, N, S and the like |

EXAMPLE 3

The three ingots (g), (h), and (i) produced contained 0.058% of carbon, 3.18% of silicon, 0.075% of manganese, 0.025% of sulfur, 0.028% of acid-soluble aluminum, 0.083% of nitrogen, and 0.13% of tin. The copper content of the three ingots was as follows: ingot (g), 0.03% of copper; ingot (h), 0.08% of copper; and ingot (i), 0.20% of copper.

These ingots were hot-rolled and subsequently were precipitation-annealed at 1150° C. for 30 seconds, followed by rapid cooling in hot water having a temperature of 100° C. The hot-rolled sheets were then pickled and cold-rolled so as to reduce the sheet thickness to 0.30 mm. During cold-rolling, aging at a temperature of 200° C. for 3 minutes was carried out between the cold-rolling passes. Subsequently, decarburization annealing was carried out at a temperature of 850° C. for 150 seconds in an atmosphere consisting of 75% hydrogen and 25% nitrogen and having a dew point of 62° C. An annealing separator consisting of a mixture of MgO and $TiO_2$ was applied on the decarburization-annealed steel sheets and then final-annealing was carried out at a temperature of 1200° C. for 20 hours. Subsequently, a coating liquid, which was mainly composed of phosphoric acid, chromic acid anhydride, and aluminum phosphate, was applied on the final-annealed steel sheets, which were then subjected to flattening-annealing.

The magnetic properties and grain size of the final products (g), (h), and (i) which were produced using the ingots (g), (h), and (i), respectively, were measured. In addition, the appearance of the surface coating of each of the final products was determined.

The properties of the final products (g), (h), and (i) are given in Table 5.

TABLE 5

| Final Product | Magnetic Properties $B_8$ (T) | W17/50 (W/Kg) | Grain Size ASTM No. × 1 | Appearance of Surface Coating |
|---|---|---|---|---|
| (g) | 1.94 | 0.98 | 5 | slightly thin |
| (h) | 1.94 | 0.96 | 5 | good |
| (i) | 1.94 | 1.00 | 3.5 | good |

The final product (h), in which the proportion of tin to copper was 1:0.6, exhibited the best properties.

EXAMPLE 4

The one ingot produced contained 0.085% of carbon, 3.2% of silicon, 0.073% of manganese, 0.025% of acid-soluble aluminum, 0.0085% of nitrogen, 0.08% of tin, and 0.07% of copper. The ingot was hot-rolled so as to obtain a hot-rolled sheet having a thickness of 2.0 mm. Subsequently, precipitation-annealing was carried out at 1130° C. for 2 minutes, followed by rapid cooling in hot water having a temperature of 100° C. The hot-rolled and precipitation-annealed sheet was pickled and cold-rolled so as to reduce the sheet thickness to 0.22 mm. During cold-rolling, aging at a temperature of 250° C. was carried out for 5 minutes between the cold-rolling passes. Subsequently, decarburization-annealing was carried out at a temperature of 850° C. for 120 seconds in an atmosphere consisting of 75% hydrogen and 25% nitrogen and having a dew point of 62° C. An annealing separator consisting of a mixture of MgO and $TiO_2$ was applied on the decarburization-annealed steel sheet, and final annealing was carried out at a temperature of 1200° C. for 20 hours. Then a coating liquid was applied on the resultant grain-oriented electromagnetic steel sheet. The grain size and the magnetic properties were as folllows:

Grain size: ASTM No. 4.5
Magnetic flux density ($B_8$): 1.92 tesla
Watt loss ($W_{15/50}$): 0.63 watts/kg
Watt loss ($W_{17/50}$): 0.88 watts/kg

We claim:

1. A process for producing a surface-coated grain-oriented electromagnetic steel sheet or strip having a low watt loss, high magnetic flux density, said method comprising the steps of:

hot rolling a slab consisting essentially of not more than 0.085% of carbon, from 2.5% to 4.0% of silicon, from 0.03% to 0.15% of manganese, from 0.010% to 0.050% of sulfur, from 0.010% to 0.050% of acid-soluble aluminum, and from 0.0045% to 0.012% of nitrogen and additionally containing from 0.03% to 0.5% of tin and from 0.02% to 0.3% of copper as a basic component, the proportion of tin to copper being in the range of from 1:0.5 to 1:1;

precipitation annealing said hot rolled strip at a temperature from 950° C. to 1200° C. for from 30 seconds to 30 minutes, followed by rapid cooling so as to precipitate AlN;

subjecting the thus annealed strip to final cold rolling step with high reduction ratio of from 80% to 95% including an aging step between the cold rolling passes, subjecting the thus cold rolled strip to decarburization-annealing;

applying an annealing separator to said decarburization-annealed strip;

subjecting the decarburization-annealed strip, on which said annealing separator is applied, to final annealing; and applying a liquid as a surface coating on the final annealed strip, said liquid being selected to provide electrical insulation and tension on the produced surface-coated grain-oriented electromagnetic steel strip.

2. A process according to claim 1, wherein the decarburization-annealing is practiced under the conditions of: an annealing temperature of from 800° C. to 900° C.; holding the annealing temperature for from 30 seconds to 10 minutes; anda protective atmosphere for annealing comprising wet hydrogen, nitrogen, or a mixture of wet hydrogen and nitrogen.

3. A process as in claim 1 wherein the annealing separator consists mainly of MgO and $TiO_2$.

4. A process as in claim 1 wherein the surface coating exhibits a tension of greater than 600 $g/mm^2$.

5. A process as in claim 4 wherein the ASTM grain size of the finally annealed steel sheet is between No. 3 to No. 5.

6. A process as in claim 1 wherein the ASTM grain size of the finally annealed steel sheet is between No. 3 to No. 5.

7. A process as in claim 1 wherein the coating liquid is composed mainly of phosphoric acid, chromic acid anhydride and aluminum phosphate.

8. A process according to claim 1 further comprising the step of flattening annealing said surface coated steel sheet.

* * * * *